US006443806B1

(12) United States Patent
Fang

(10) Patent No.: US 6,443,806 B1
(45) Date of Patent: Sep. 3, 2002

(54) BREAST LIFT FOR BRASSIERE

(76) Inventor: Kuo Feng Fang, No. 61, Guei Yang St. Tai Hsan Hsiang, Taipei Hsien (TW)

( * ) Notice: Subject to any disclaimer, the term of this patent is extended or adjusted under 35 U.S.C. 154(b) by 0 days.

(21) Appl. No.: 09/846,610

(22) Filed: May 2, 2001

(51) Int. Cl.[7] ..... A41C 3/00
(52) U.S. Cl. ..... 450/57; 450/55
(58) Field of Search ..... 450/38, 54–57; 2/267, 268; 623/7.8

(56) References Cited

U.S. PATENT DOCUMENTS 3,494,365 A * 2/1970 Beals ..... 450/38
3,896,506 A * 7/1975 Harkin et al. ..... 623/7
3,911,503 A * 10/1975 Hankin ..... 623/7
4,247,351 A * 1/1981 Rechenberg ..... 623/7
5,997,380 A * 12/1999 Yang ..... 450/57
6,101,630 A * 8/2000 Lee ..... 450/57
6,132,288 A * 10/2000 Aerts ..... 450/38
6,224,458 B1 * 5/2001 Chen ..... 450/57

* cited by examiner

*Primary Examiner*—Gloria M. Hale
(74) *Attorney, Agent, or Firm*—Rosenberg, Klein & Lee

(57) ABSTRACT

A breast lift for brassiere, includes a bladder made of resilient, soft, waterproof material by fusion, a foamed silicon rubber material stuffed in the bladder, the foamed silicon rubber material having air bubbles therein, and at least one ventilation groove extended across a thick lower part of the bladder.

8 Claims, 4 Drawing Sheets

BREAST LIFT FOR BRASSIERE

BACKGROUND OF THE INVENTION

The present invention relates to brassieres and, more specifically, to a breast lift for brassiere, which is light in weight and comfortable in use and, which effectively supports the breast in shape.

In recent years, the living standard of people around the world is greatly improved following fast development of economics. In sequence, most women care about their exterior look. In order to support the breasts in shape, brassieres with breast lift means may be used. Various materials have been developed and used for making breast lifts. Conventionally, silicon rubber is used for making breast lifts. A breast lift made of silicon rubber is practical to support the breast in shape and has a nice touch, however it is heavy and expensive. Liquid material may be used for breast lift. FIG. 1A shows a breast lift 10 comprised of a bladder 14 made of flexible waterproof material by fusion, and a fluid 12 filled in the bladder 14. The fluid 12 can be liquid silicon, water, oil, gaseous material, or the like. This structure of breast lift is light in weight and less expensive. However, it is not comfortable in use. Because the bladder 14 is made of flexible waterproof material and covers the major part of the breast (see FIG. 1B), it prohibits ventilation around the front side of the breast.

SUMMARY OF THE INVENTION

The present invention has been accomplished to provide a breast lift for brassiere, which eliminates the aforesaid drawbacks. It is one object of the present invention to provide a breast lift, which is light in weight and comfortable in use. It is another object of the present invention to provide a breast lift, which is inexpensive to manufacture. It is still another object of the present invention to provide a breast lift, which provides a satisfactory ventilation effect. According to one aspect of the present invention, the breast lift comprises a bladder made of resilient, soft, waterproof material by fusion, and a foamed silicon rubber material stuffed in the bladder. Because the breast lift is stuffed with a foamed silicon rubber material, it is light in weight and soft in touch, further, it saves much material cost. According to another aspect of the present invention, the lower part of the breast lift is relatively thicker than the upper part thereof, and the upper part is reinforced with a reinforcing rib. Therefore, the breast lift effectively supports the breast in shape.

DETAILED DESCRIPTION OF THE PREFERRED EMBODIMENT

Figure 1A:
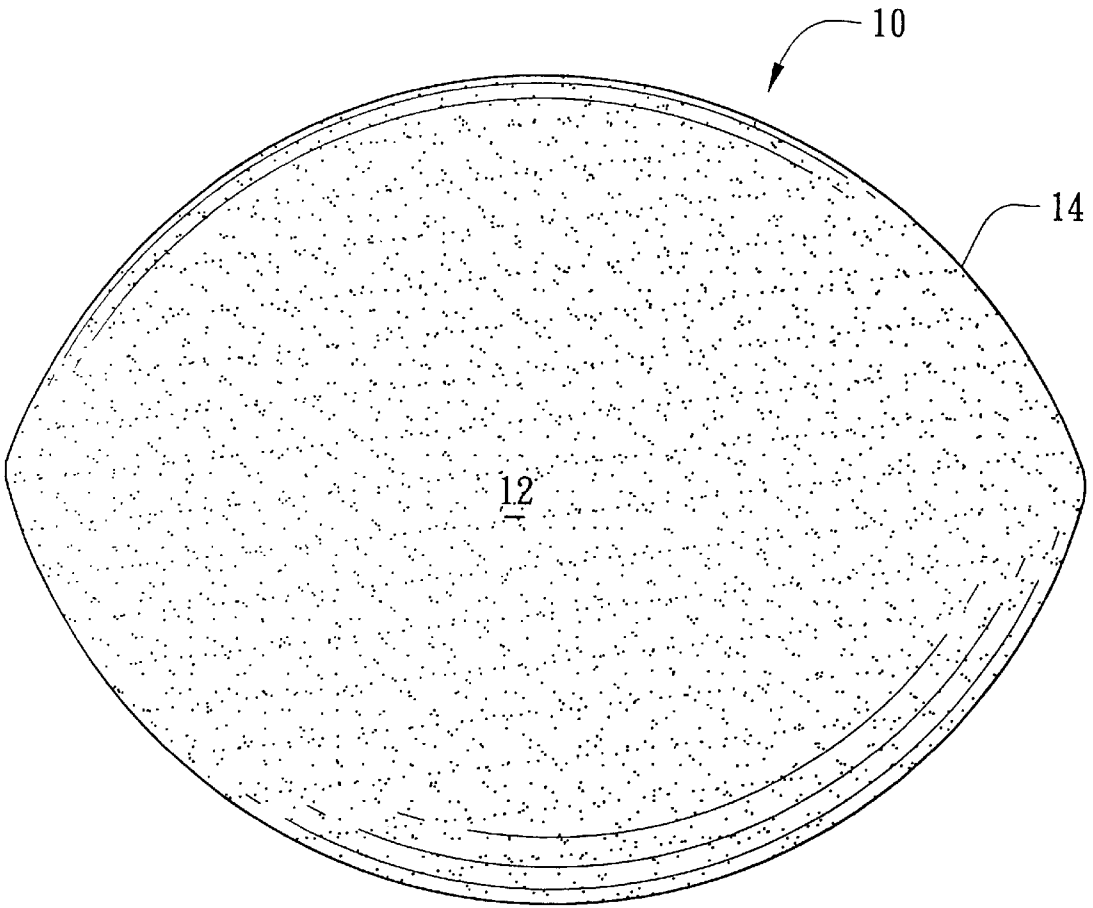
FIG.1A (PRIOR ART)
FIG. 1A is a front view of a breast lift for brassiere according to the prior art.
Figure 1B:
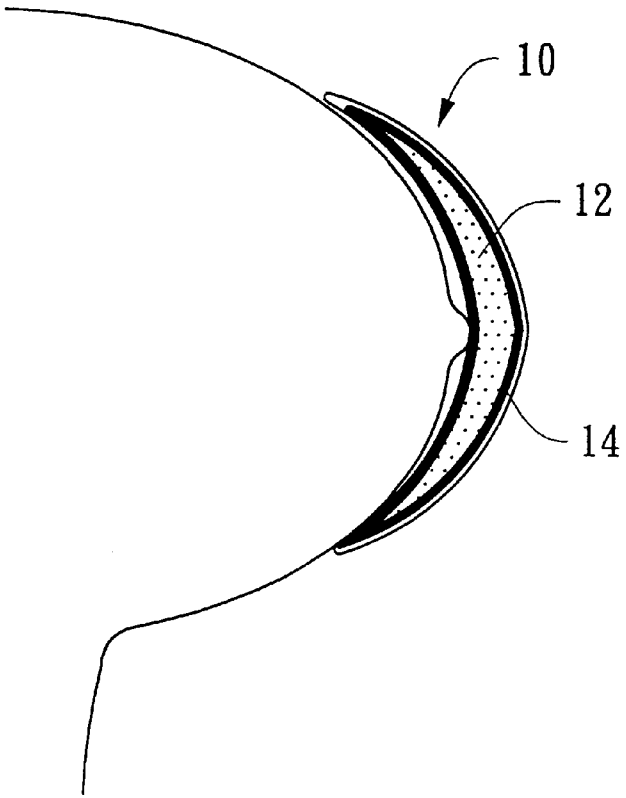
FIG.1B (PRIOR ART)
FIG. 1B is a schematic drawing showing the prior art breast lift covered on the breast.
Figure 2:
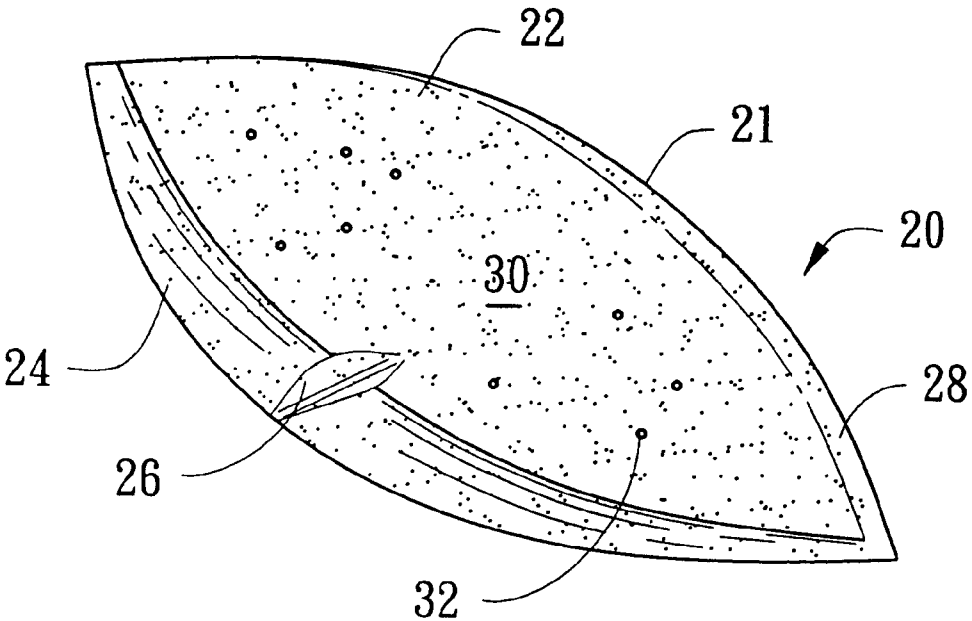
FIG. 2 is a perspective view of a breast lift constructed according to the present invention.
Figure 3:
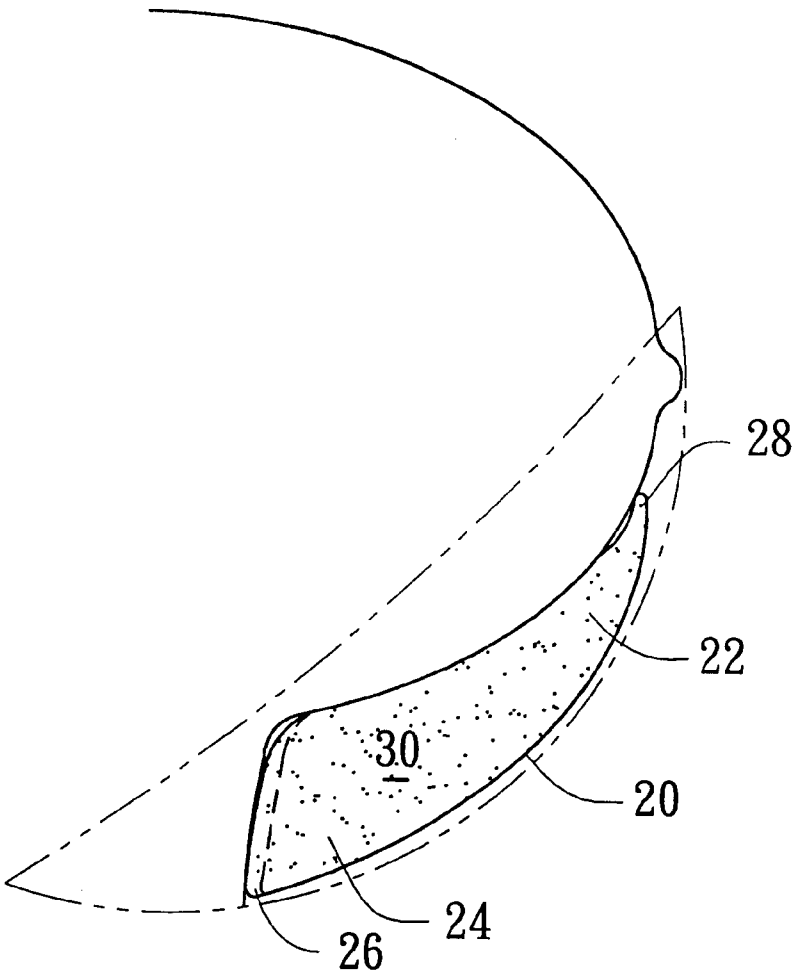
FIG. 3 is a schematic drawing showing the use of the breast lift according to the present invention.

Referring to FIG. 2, a breast lift 20 is shown comprising a bladder 21, and a foamed silicon rubber material 30 stuffed in the bladder 21. The bladder 21 is made of resilient, soft, waterproof material by fusion, comprising an upper part 22 and a lower part 24. The volume of the foamed silicon rubber material 30 around the lower part 24 is greater than that around the upper part 22, i.e. the thickness of the lower part 24 is greater than that of the upper part 22 so that the lower part 24 supports the load of the breast tightly and the upper part 22 is maintained is close contact with the contour of the breast, keeping the breast in a lifted shape as shown in FIG. 3. The breast lift 20 has at least one ventilation groove 26 formed through, and extending transversely across, the lower part 24. When in use, body heat can be quickly dissipated from the breast through the at least one ventilation groove 26 to the air outside the brassiere through convective heat transfer. The breast lift 20 further comprises a reinforcing rib 28 extended along the border area of the upper part 22. The reinforcing rib 28 reinforces the structural strength and keeps the breast lift in shape. The reinforcing rib 28 extends around the periphery of the breast lift 20 as shown in the FIGS. and may be formed integrally with the breast lift 20 for purposes of reinforcing the relatively flexible material composition forming the lift 20, as is known in the prior art. bubbles 32 in it. Because tiny air bubbles 32 exist in the foamed silicon rubber material 30, the foamed silicon rubber material 30 is light in weight and soft in touch. In case a 50 g solid silicon rubber material is used to stuff the breast lift 20, same volume of foamed silicon rubber material 30 takes only 22.5 g. Therefore, the foamed silicon rubber material 30 reduces the weight by about 55%.

In order to adjust the softness, a softener may be added when preparing the foamed silicon rubber material 30. Past-like material may be used instead of the foamed silicon rubber material 30 to function the same effect.

While only one embodiment of the present invention has been shown and described, it will be understood that various modifications and changes could be made thereunto without departing from the spirit and scope of the invention disclosed.

What the invention claimed is:

1. A breast lift for a brassiere, comprising a bladder formed of a resilient, soft, waterproof material formed through a fusion process, said bladder forming an upper portion and a lower portion, said lower portion having a thicker dimension than said upper portion, said upper and lower portions being formed in a molded one-piece arcuate contour, a resilient material being received within said bladder, and at least one ventilation groove formed through and extending across said lower portion, a first volume of said resilient material received within said lower portion being greater than that of a second volume of said resilient material received within said upper portion.

2. The breast lift of claim 1, further comprising a reinforcing rib extending along a periphery of said upper portion of said bladder.

3. The breast lift of claim 1 wherein said resilient material is a foamed silicon rubber material having air bubbles formed therein.

4. The breast lift of claim 3 wherein said foamed silicon rubber material has a softener agent added thereto.

5. A breast lift for a brassiere, comprising a bladder formed of a resilient, soft, waterproof material formed through a thermal fusion process, and a foamed silicon rubber material received within said bladder, said foamed silicon rubber material having air bubbles formed therein, said bladder forming upper and lower portions, said lower portion having a thicker dimension than said upper portion, said upper and lower portions being formed in a molded one-piece arcuate contour.

6. The breast lift of claim 5 wherein said foamed silicon rubber material has a softener agent added thereto.

7. The breast lift of claim 5 further comprising a reinforcing rib extending along a periphery of said upper portion.

8. The breast lift of claim 5 further comprising at least one ventilation groove formed through and extending across said lower portion of said bladder.

* * * * *